United States Patent [19]

Taub

[11] Patent Number: 4,932,708

[45] Date of Patent: Jun. 12, 1990

[54] SAFETY COVER FOR VEHICLE DOOR MECHANISMS

[76] Inventor: Sandra J. Taub, 2027 Chrisdon Rd., Burlington, Ontario, Canada, L7M 3W8

[21] Appl. No.: 442,079

[22] Filed: Nov. 28, 1989

[51] Int. Cl.[5] ..... E05C 19/18

[52] U.S. Cl. ..... 292/347; 70/181; 292/346; 292/288; 292/DIG. 2

[58] Field of Search ..... 70/181; 292/346, DIG. 2, 292/288, 347, 258

[56] References Cited

U.S. PATENT DOCUMENTS

| | | | |
|---|---|---|---|
| 2,482,340 | 9/1949 | Holmsten | 292/346 |
| 2,523,940 | 9/1950 | Bronson | 292/33 |
| 2,537,380 | 1/1951 | Travis | 292/288 |
| 2,760,803 | 8/1956 | Solomon | 70/181 X |
| 2,793,064 | 5/1957 | Budoff | 292/288 |
| 3,416,827 | 12/1968 | Colo | 292/288 |
| 3,606,421 | 9/1971 | Reichenbach | 292/288 X |
| 3,837,191 | 9/1974 | Soiderer | 292/346 X |
| 3,990,792 | 12/1976 | Smith | 292/346 |
| 4,101,155 | 7/1978 | Cohen | 292/DIG. 2 X |
| 4,781,042 | 11/1988 | Stephens | 292/288 |

*Primary Examiner*—Richard E. Moore

*Attorney, Agent, or Firm*—Ridout & Maybee

[57] ABSTRACT

The present invention provides a cover for use in a vehicle such as an automobile for covering door operating elements thereby concealing them from children. The cover is in the form of a rectangular box-like housing which is placed over any upwardly projecting elements such as a locking button, the housing having a bowed front flange which hides such elements as a latching handle on the inside of the door. A rear flange can be inserted between the window and the lower door portion to retain the cover in position.

5 Claims, 1 Drawing Sheet

SAFETY COVER FOR VEHICLE DOOR MECHANISMS

Figure 2:
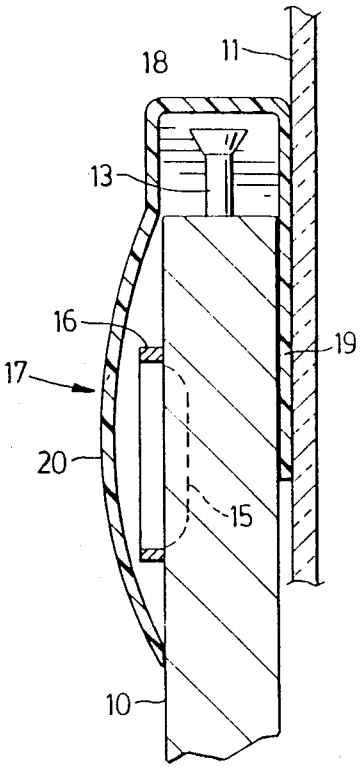

The present invention relates to a safety cover for use in a vehicle, such as an automobile, having interiorly accessible door operating and locking means. The door of such a vehicle typically comprises a lower door portion on which the interiorly accessible door operating and locking means are mounted and a vertically retractable pane portion extending from an upper edge of the lower door portion.

The fact that the door operating and locking means are accessible from within the vehicle presents a hazard to young children who may be tempted to tamper with such means and unintentionally open the door. This hazard has long been recognized, and various solutions have been proposed for preventing children from tampering with the door mechanism. Such solutions generally involve using additional security devices interconnected with the door mechanism for denying a child access to the door mechanism, by reason of the child's small hands or lack of dexterity, while leaving the mechanism readily accessible for adults.

The present invention, instead of providing a complex device to be mounted on the door for denying a child physical access to the door mechanism, provides a simple cover which can be readily mounted on the interior side of the door so as to cover the accessible parts of the door operating and locking means thereby reducing the temptation to tamper with such parts by hiding them from sight.

Accordingly, the invention provides, for use on a vehicle door of the type referred to, a safety cover comprising an elongate housing of inverted channel shape having one open side adapted to lie along the upper edge of the lower door portion adjacent the pane to accommodate elements projecting from said upper edge, the housing having an integral, rigid rear flange extending from one longitudinal edge of said opening to lie between the pane and the lower door portion for supporting the cover in position, and an integral, resilient front flange of convexedly bowed shape extending from the other longitudinal edge of said open side of the housing, the front flange being of a size such as to extend across and conceal elements mounted on or projecting from the interior side of said lower door portion and having a bottom edge adapted to bear resiliently against the inside of the door.

The inverted channel-shaped housing may be open at its ends or closed at its ends.

Figure 1:
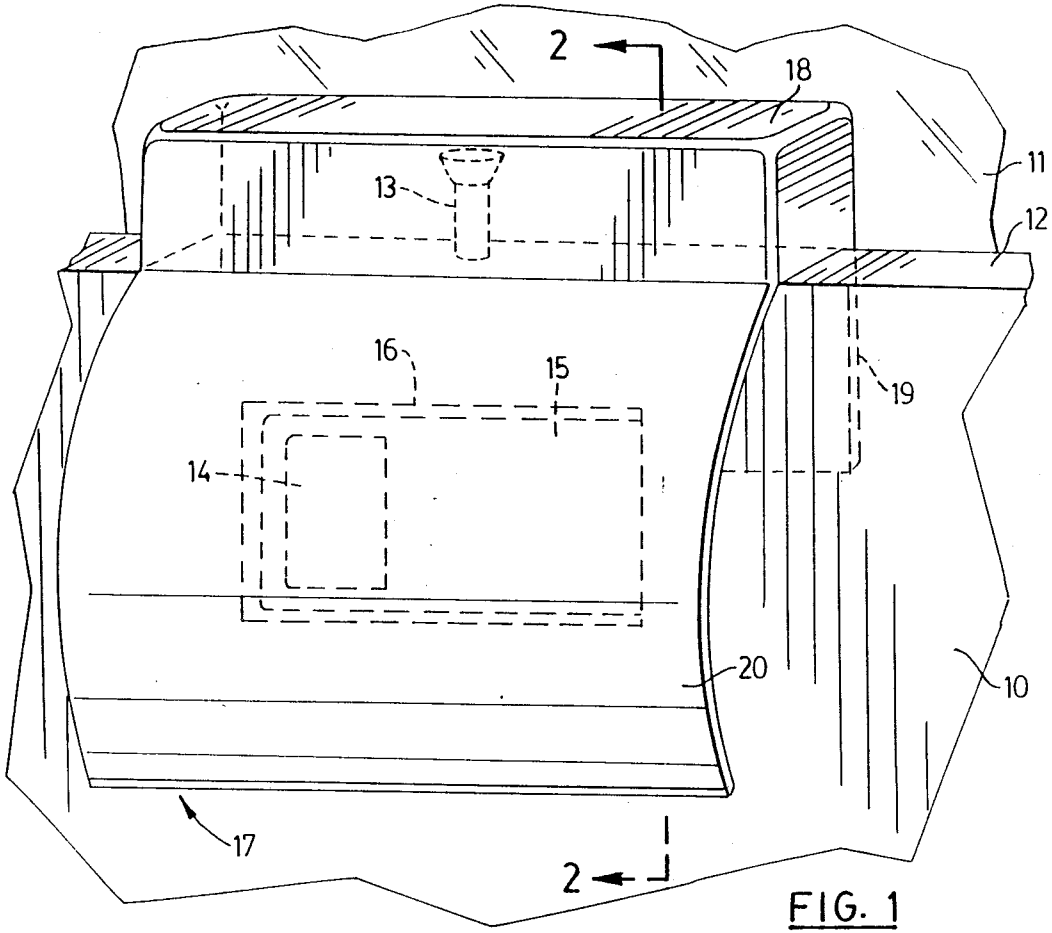

In order that the invention may be more readily understood, a preferred embodiment thereof will now be described, by way of example, with reference to the accompanying drawings. In the drawings:

FIG. 1 is a perspective view of the safety cover as seen when mounted on a vehicle door; and FIG. 2 is a vertical section taken on line 2—2 in FIG. 1.

The safety cover of the present invention is adapted to be mounted on the inside of a vehicle door, more particularly an automobile door, and is constructed so as to conceal elements of the door operating and locking mechanism which have to be accessible from the interior of the vehicle. As previously mentioned, such elements, when exposed to view, offer temptation to a young child who may wish to tamper with them.

In the drawings the door is shown schematically and basically comprises a lower door portion 10 and vertically retractable pane portion 11 which, when the window is closed or partially closed, extends upwardly from the upper edge 12 of the lower door portion. The pane portion 11 can be retracted in a well provided by the lower door portion for opening the window. The door operating and locking means are housed within the lower door portion and provide accessible operating elements which, in the present example, include a locking button 13 projecting from the upper edge of the door portion 10 and a latch handle 14 on the inside of the door. In the illustrated example the latch handle 14 is accommodated in a recess 15. The inside surface of the door will not usually be flat as shown, but will generally be contoured and may have projecting parts. In the present example the only interior projection shown is a moulding 16 around the recess 15.

The safety cover of the present invention is denoted by the general reference numeral 17. The cover is of fairly stiff resilient material, such as vinyl sheet, shaped to form an elongate housing portion 18 of inverted channel shape 18, an integral rear flange 19, and an integral resilient front flange 20. In the present example the housing 18 is closed at its opposite ends to provide a rectangular box-like portion, but it is to be understood that it may alternatively be open-ended. The box-like portion 18 has just one open side which is adapted to lie along the upper edge 12 of the door portion 10 as shown in the drawings so that elements projecting from the upper edge of the lower door portion, such as the locking button 13, project into the box-like portion 18 and are concealed by it. The cover is supported in position by the relatively rigid rear flange 19 which extends downwardly into the well of the lower door portion and is held between the pane portion 11 and the front wall of the lower door portion.

The resilient front flange 20 is convexedly bowed so that its lower edge bears resiliently against the inside surface of the lower door portion. The front flange thus extends over and conceals elements such as the latch handle 14 mounted on the inside of said lower door portion, and by virtue of its bowed shape clears projecting elements such as the moulding 16 over which it extends.

In an alternative embodiment of the invention the cover is constructed from a single sheet of resilient, relatively stiff, material such as vinyl plastic, the sheet being folded about longitudinal fold lines into the configuration shown in FIGS. 1 and 2 except that the ends of the inverted channel formed by the housing portion 18 are open.

The safety cover of the present invention has the advantage of simplicity. It is in one piece and is not interconnected with any parts of the door mechanism. It can easily be installed on, or removed from, any vehicle door of the kind described in which the lower door portion provides a slot or well into which the door pane can be retracted to open the window and provides a space in which the rear flange of the cover can be sandwiched between the pane and the inside door panel. In use, the cover conceals elements of the door mechanisms which a young child may wish to play with. Furthermore, the cover prevents access to the door operating elements while it is mounted in position, and although it can easily be removed by an adult or an older child, it presents a formidable obstacle to a younger child who might be tempted to remove it.

It is to be noted that, since the cover conceals elements of the door locking mechanism, it advantageously presents an obstacle to illegal entry of the automobile by tampering with the locking mechanism through a partially open window.

I claim:

1. A safety cover for use on a vehicle door of the kind having a lower door portion and a vertically retractable pane extending from an upper edge of the lower door portion, the cover comprising an elongate housing of inverted channel shape having one open side adapted to lie along the upper edge of said lower door portion adjacent the pane to accommodate and enclose elements projecting from said upper edge, the housing having an integral, relatively rigid rear flange extending from one longitudinal edge of said open side, said rear flange being adapted to be inserted between the pane and an inside panel of the lower door portion for supporting the cover in position, and an integral, resilient front flange of convexedly bowed shape extending from the other longitudinal edge of said open side of the housing, said front flange being of a size such as to extend across and conceal elements of the door mechanisms mounted on or projecting from the interior side of said lower door portion and having a bottom edge adapted to bear resiliently against said interior side of the door.

2. A safety cover according to claim 1, wherein the cover is of resilient, relatively stiff, sheet material.

3. A safety cover according to claim 2, wherein the cover is of vinyl plastic.

4. A safety cover according to claim 2, wherein said housing of inverted channel shape is closed at its ends.

5. A safety cover according to claim 2, constructed from a single sheet of said material, said housing of inverted channel shape being open at its ends.

* * * * *